US005634298A

United States Patent [19]

Slopack

[11] Patent Number: 5,634,298

[45] Date of Patent: Jun. 3, 1997

[54] ELECTRO-MECHANICAL DOOR OPENING AND CLOSING DEVICE

[75] Inventor: Herbert N. Slopack, Markham, Canada

[73] Assignee: 1101939 Ontario, Inc., Markham, Canada

[21] Appl. No.: 518,603

[22] Filed: Aug. 21, 1995

Related U.S. Application Data

[63] Continuation-in-part of Ser. No. 360,364, Dec. 21, 1994, abandoned.

[51] Int. Cl.[6] ..... E05F 11/00

[52] U.S. Cl. ..... 49/360; 49/362

[58] Field of Search ..... 49/360, 362, 139, 49/140, 25

[56] References Cited

U.S. PATENT DOCUMENTS

| | | | |
|---|---|---|---|
| 3,469,345 | 9/1969 | Hanks | 49/362 X |
| 3,890,744 | 6/1975 | Galis . | |
| 4,229,907 | 10/1980 | Hall | 49/362 |
| 4,541,202 | 9/1985 | Dockery | 49/362 |
| 4,893,435 | 1/1990 | Shalit . | |
| 5,301,734 | 4/1994 | Opel | 49/362 X |
| 5,355,624 | 10/1994 | Bacon | 49/362 X |
| 5,422,552 | 6/1995 | Parisi | 49/360 X |

*Primary Examiner*—Kenneth J. Dorner
*Assistant Examiner*—Jerry Redman
*Attorney, Agent, or Firm*—Hill & Schumacher

[57] ABSTRACT

There is disclosed an electro-mechanical door opening and closing device which is adapted to be retro-fitted onto an existing manually operated sliding door system. The sliding door system has a stationary panel and a movable panel and the system is installed in a wall of a building. A stationary portion includes the stationary panel, the door frame and the building adjacent to the door frame. The device includes a reversible motor, a bracket or handle and a control system. The reversible motor is attachable to one of the stationary portion and the movable panel. The bracket is attachable to the other of the stationary portion and the movable panel. The device includes a threaded rod operably connected to the reversible motor such that the rod may be rotated clockwise and counterclockwise. The rod is also movably connected to the bracket and rotation of the rod clockwise and counterclockwise causes the bracket to move towards and away from the motor thereby opening and closing the sliding panel. Combined the rod and bracket is similar to a power screw. The control system is operably connected to the reversible motor to control activation, direction and deactivation of the motor. Preferably the bracket includes a disengagable coupling mechanism with an engaged position, wherein the slidable panel is moved by the method of moving, and a release position, wherein the slidable panel is moved manually.

17 Claims, 15 Drawing Sheets

ELECTRO-MECHANICAL DOOR OPENING AND CLOSING DEVICE

RELATED APPLICATIONS

This application is a continuation-in-part application of U.S. patent application Ser. No. 08/360,364 filed Dec. 21, 1994 now abandoned.

FIELD OF THE INVENTION

This invention relates to door opening and closing devices and in particular to electro-mechanical door opening and closing devices for use with sliding doors.

BACKGROUND OF THE INVENTION

Sliding doors are commonly used in residential housing both in houses, to provide access to the outdoors typically the backyard, and in apartments, to provide access to balconies. These sliding doors are typically made of tempered glass with metal or wood frames and provide a source of natural light. However, these doors are heavy and can be difficult to open especially for children, elderly people, handicapped individuals and adults when their hands are full. Accordingly it would be desirable to provide a means to open the sliding door easily.

Some commercial automatic sliding door systems are currently available such as those found in supermarkets. Such systems typically either include a sensing device or a pressure activated mat, either of which, when activated cause the door to open. The door's opening and closing mechanism and sensors combine to form an integral system wherein none of the components could operate independently. These systems are very large and would be costly to install in a home.

Some solutions have been suggested for residential sliding doors. For example U.S. Pat. No. 3,890,744 issued to Gallis on Jun. 24, 1975. The Gallis patent includes a housing which is mounted on the floor adjacent to a fixed glass door. Within the housing is an endless belt which is attached to the sliding door and is driven by an electric motor also located within the housing. Electrical limit switches act to stop the door at its open and closed positions. A solenoid is connected to the motor to tighten the belt when electric power is applied. When electric power is not applied the belt is lose and the door can be opened manually. Alternatively a locking means is suggested wherein the belt is kept taught through continuously energizing the solenoid.

Another sliding door opening system is disclosed in U.S. Pat. No. 4,893,435 issued to Shalit on Jan. 16, 1990. This system is similar to the Gallis system in that it uses an endless belt attached to the sliding door which is driven by an electrical motor. Shalit varies the Gallis system by providing the endless belt in a low profile housing and spacing the motor above and to one side of the housing adjacent the sliding doors. The belt is a toothed belt which engages a toothed sprocket. The toothed sprocket is driven by the motor. Further, Shalit provides a locking pin which engages the toothed sprocket and holds it in position. When the motor is engaged a solenoid is energised which disengages the locking pin. The locking pin can also be manually disengaged. There is a clutch between the toothed sprocket and the motor so that when the motor is not energised the door can be opened and closed manually.

Both of these are continuous loop-type systems with a multiplicity of components. Each of these components adds to the cost of manufacturing and affects the reliability of the device.

Accordingly it is desirable to provide a door opening and closing device that can easily be retro-fitted onto existing residential sliding door systems. It is desirable that such a device is easy and relatively inexpensive to manufacture. Such a device could be adapted so that a child could activate it and/or so that a dog or another pet could activate it. Further it could be adapted so that it could be activated remotely. Such a device would fulfil various needs as a convenience device. It would make sliding doors operable even when the users hands were full and it would allow a small child to operate the sliding doors. It could provide for the automatic closing of the door if so desired. As a handicap aid, it would give more independence to those in wheelchairs, those using walkers and seniors that may be too weak to operate the doors manually. As a pet door opening device it would free the pet owner from having to manually opening the door whenever the pet wants to come in or go out.

SUMMARY OF THE INVENTION

The present invention provides an electro-mechanical door opening and closing device which can be retrofitted onto an already installed sliding door system. Alternatively, the electro-mechanical door opening and closing device could be attached to the sliding door system during manufacturing and then installed in the building thereafter as a unit.

In accordance with one aspect of the invention, a electro-mechanical door opening and closing device is adapted to be retro-fitted onto an existing manually operated sliding door system. The sliding door system has a stationary panel and a movable panel and the system is installed in a wall of a building. A stationary portion includes the stationary panel, the door frame and the building adjacent to the door frame. The device includes a reversible motor, a bracket or handle and a control system. The reversible motor is attachable to one of the stationary portion and the movable panel. The bracket is attachable to the other of the stationary portion and the movable panel. The device includes a threaded rod operably connected to the reversible motor such that the red may be rotated clockwise and counterclockwise. The rod is also movably connected to the bracket and rotation of the rod clockwise and counterclockwise causes the bracket to move towards and away from the motor thereby opening and closing the sliding panel. The control system is operably connected to the reversible motor to control activation, direction and deactivation of the motor. Preferably the bracket includes a disengagable coupling mechanism with an engaged position, wherein the slidable panel is moved by the method of moving, and a release position, wherein the slidable panel is moved manually.

In another aspect of the invention an electro-mechanical device is attached to a sliding door system which is adapted to be installed in a wall of a building. The sliding door system has a movable panel and a stationary panel. The electro-mechanical device includes a reversible motor, a bracket and a control system. The reversible motor is attached to one of the stationary panel and the movable panel. The bracket is attached to the other of the stationary panel and the movable panel. The device includes a threaded rod operably connected to the reversible motor such that the rod may be rotated clockwise and counterclockwise. The rod is also connected to the bracket and rotation of the rod clockwise and counterclockwise causes the bracket to move towards and away from the motor thereby opening and closing the sliding panel. The control system is operably connected to the reversible motor to control activation, direction and deactivation of the motor.

Further features of the invention will be described or will become apparent in the course of the following detailed description.

BRIEF DESCRIPTION OF THE DRAWINGS

The invention will now be described by way of example only, with reference to the accompanying drawings, in which.

DETAILED DESCRIPTION OF THE INVENTION

Figure 1:
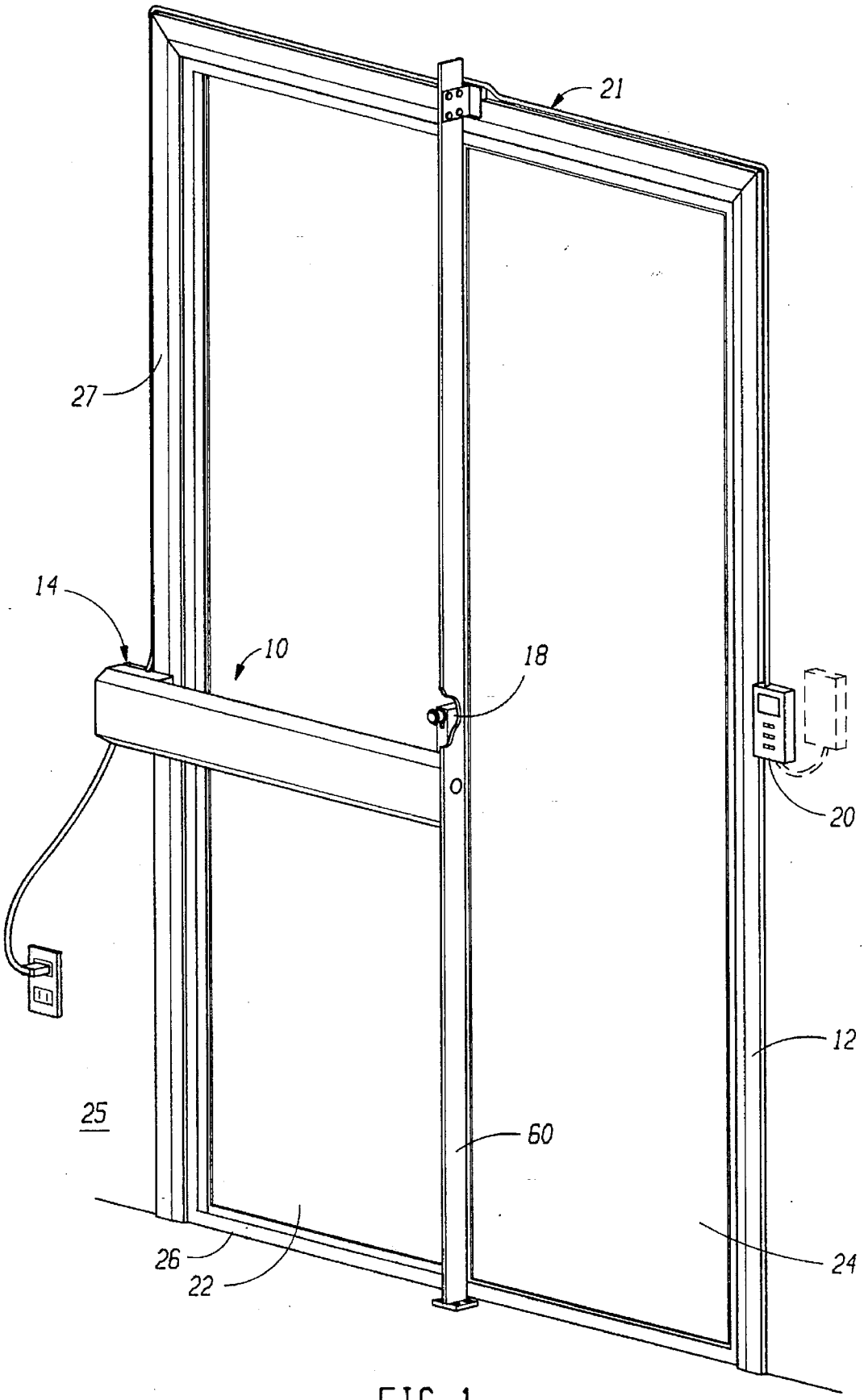
FIG. 1 is a perspective view of the electro-mechanical door opening and closing device constructed in accordance with the present invention and installed on a sliding door system.
Figure 1A:
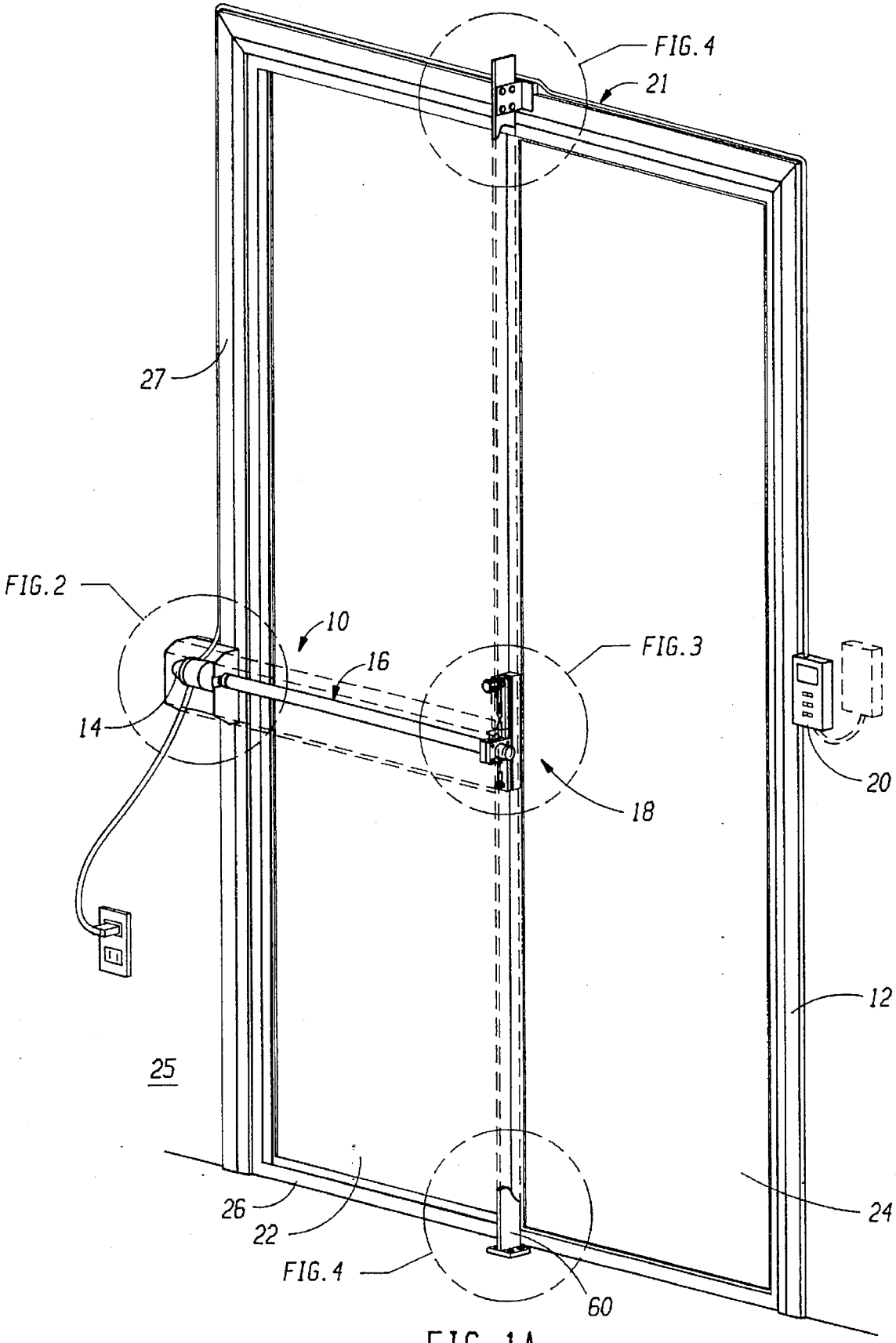
FIG. 1A is a perspective view of the electro-mechanical door opening and closing device as shown in FIG. 1 with the vertical support and the shield shown in phantom.

Referring to FIG. 1, the electro-mechanical door opening and closing device embodying the subject invention is shown generally at 10. Device 10 is adapted to be retro-fitted to a residential sliding door 12. Typically residential sliding doors 12 include a stationary panel 22, a slidable door 24 and a frame 26. Doors 12 are typically located in an exterior wall of the house 25 and typically wooden molding 27 surrounds doors 12. Device 10 includes a reversible motor 14, a handle or bracket 18 attached to the slidable door 24, a means to move the handle 18 toward the stationary panel and a controller 20 electrically connected to motor 14 by cable 21.

Figure 2:
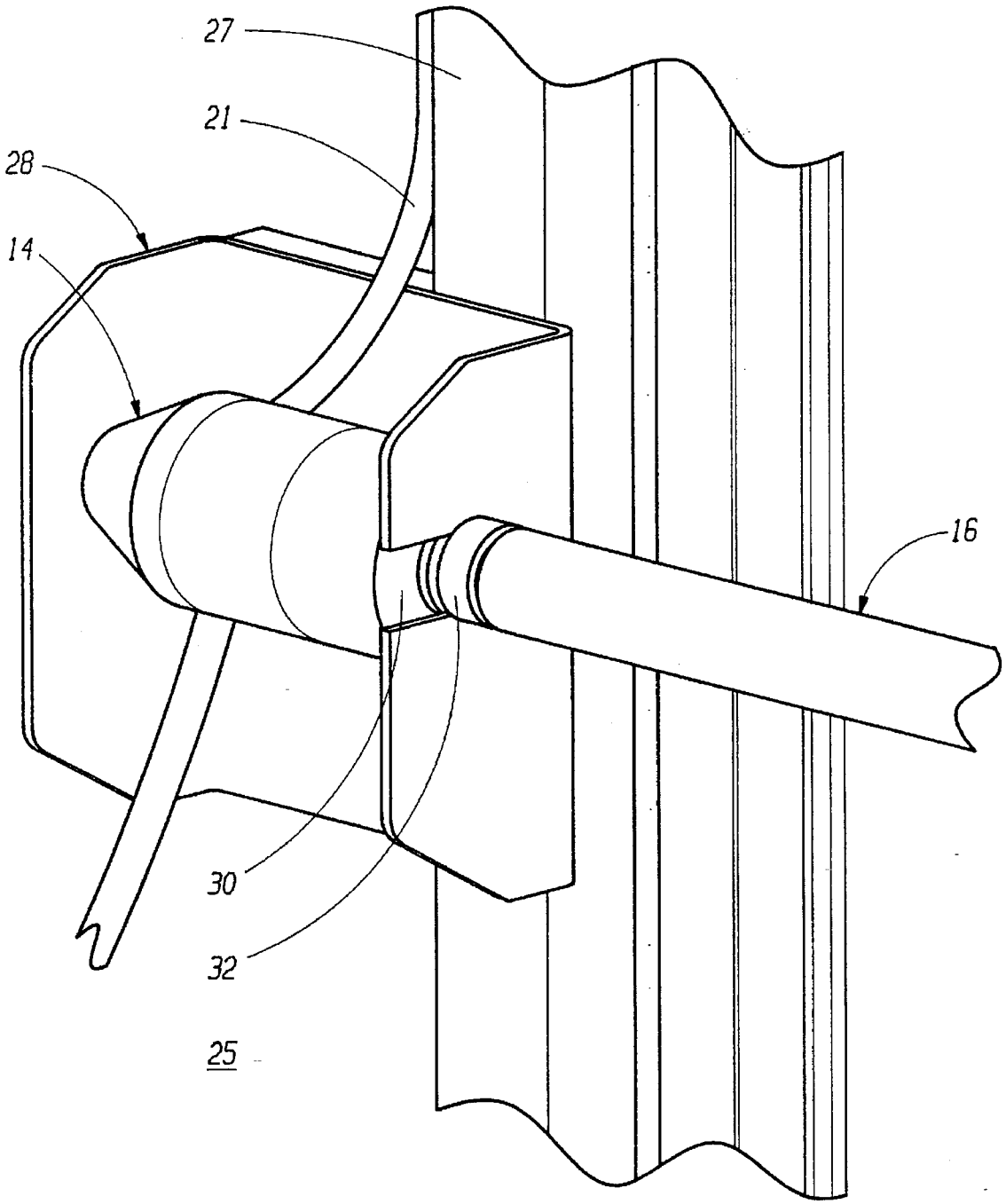
FIG. 2 is a perspective view of the motor portion of the door opening and closing device having the shield removed.
Figure 6:
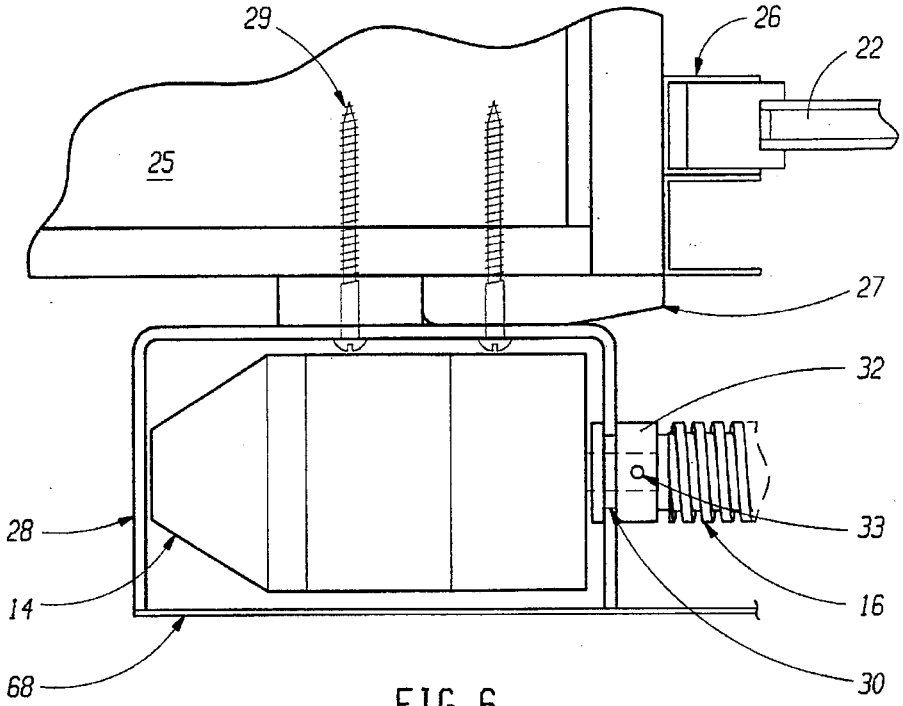
FIG. 6 is a top view of the attachment of the motor of the door opening and closing device to the house.
Figure 14:
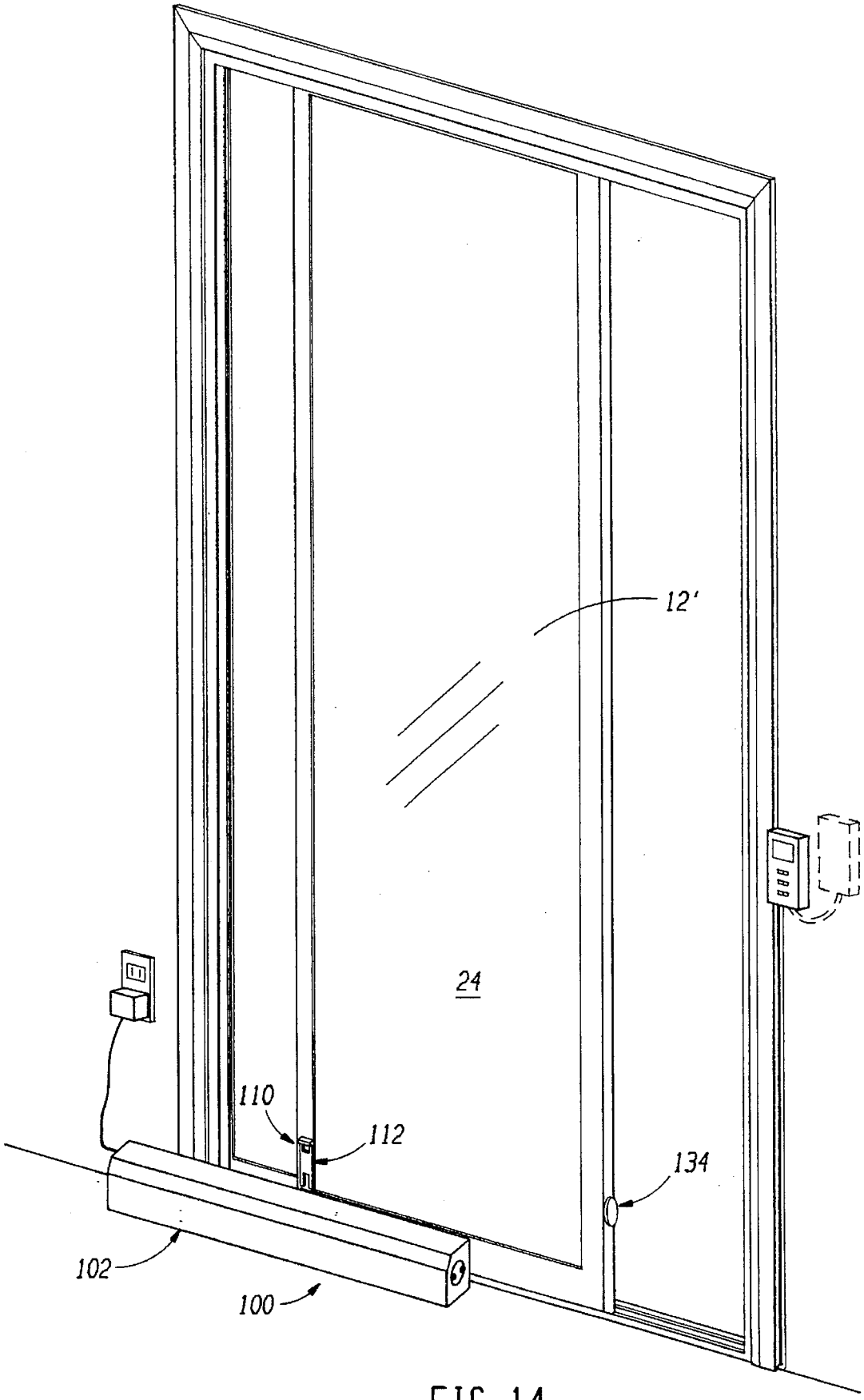
FIG. 14 is a perspective view of the electro-mechanical door opening and closing device similar to that shown in FIG. 9 and including a heat sensor as a safety mechanism.
Figure 15:
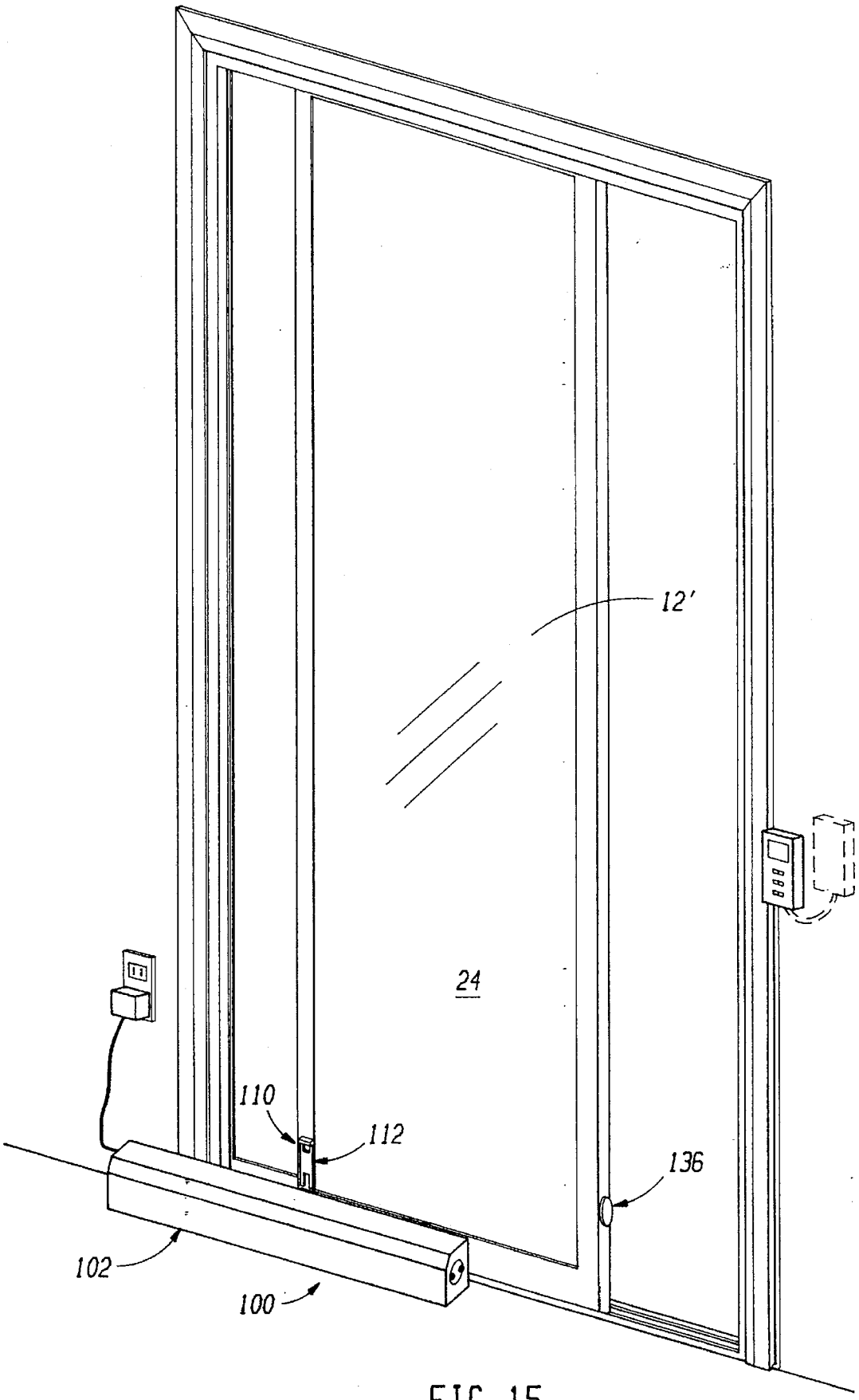
FIG. 15 is a perspective view of the electro-mechanical door opening and closing device similar to that shown in FIG. 9 and including a motion detector as a safety mechanism.

Reversible motor 14, shown in detail in FIGS. 2 and 6, is housed in a motor support bracket 28 which is attached to house 25 through moulding 27 with screws 29 (FIG. 6). Motor support bracket 28 has an aperture 30 formed therein for receiving a threaded rod 16. Motor 14 is provided with a control system (not shown) which is electrically attached to motor 14. Preferably control system includes a chip, controller 20 and safety mechanism. The signal from controller 20 is received by the chip through cable 21. Safety mechanism could be chosen from a number of options well know to those skilled in the art. For example, safety mechanism could include a torque sensor or current sensor such that when the door movement is obstructed the motor requires an increase in power for the door to continue moving at the same speed, and this increase would act as a signal to turn motor 14 off. Further, the safety mechanism could include a heat sensor 134 (shown in FIG. 14) which would be attached to the slidable door or the door frame such that if a person touched the sensor, motor 14 would turn off. In addition, the safety mechanism could include a motion sensor 136 (shown in FIG. 15) such that if motion is detected in a predetermined space motor 14 would turn off. The safety mechanism could include one or more of these or other safety mechanism generally known to those skilled in the art. Reversible motor 14 is described as such because it provides the force to both open and close slidable door 24.

Means to move the handle or bracket 18 preferably includes threaded rod 16 operably connected to reversible motor 14 together these are often referred to as a power screw. Coupling 32 may be an integral part of rod 16. Coupling 32 transfers the load from rod 16 to motor support bracket 28. Coupling 32 is positioned in aperture 30. A set screw 33 (FIG. 6) transmits the power from motor 14 to rod 16. It will be appreciated by those skilled in the art that there are a number of other ways of transmitting this power for example it also could be done by way of a key attachment.

Threaded rod 16 is releasably attached to handle or bracket 18. Preferably rod 16 is a square threaded rod. Preferably rod 16 is a nylon rod made from NYLATRON GS™.

Figure 3:
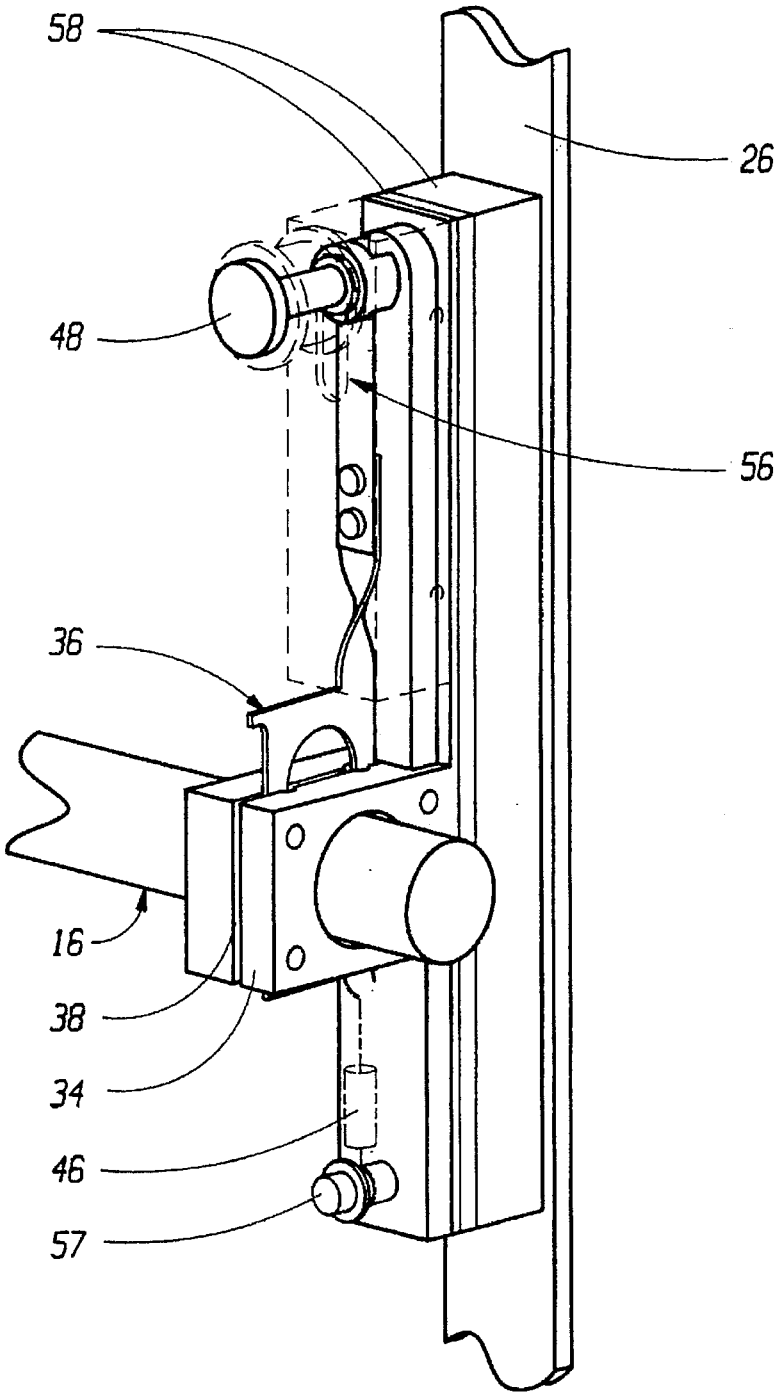
FIG. 3 is a perspective view of the handle portion of the door opening and closing device having the shield removed.
Figure 5A:
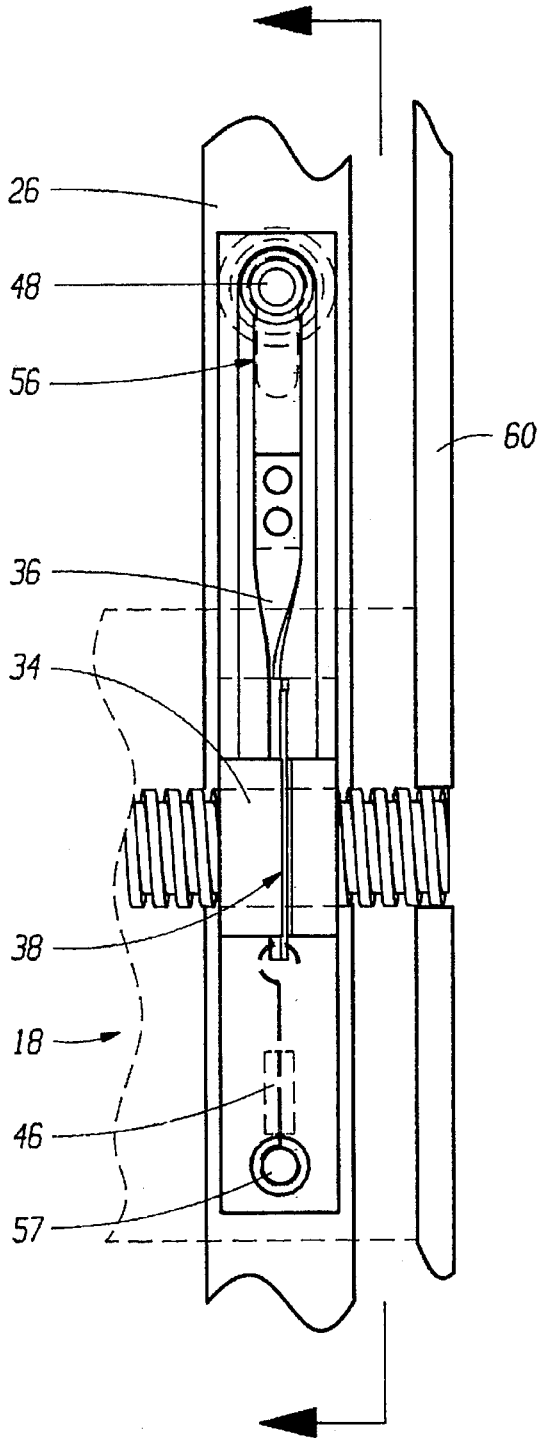
FIG. 5A is a front view of the handle of the door opening and closing device.
Figure 5B:
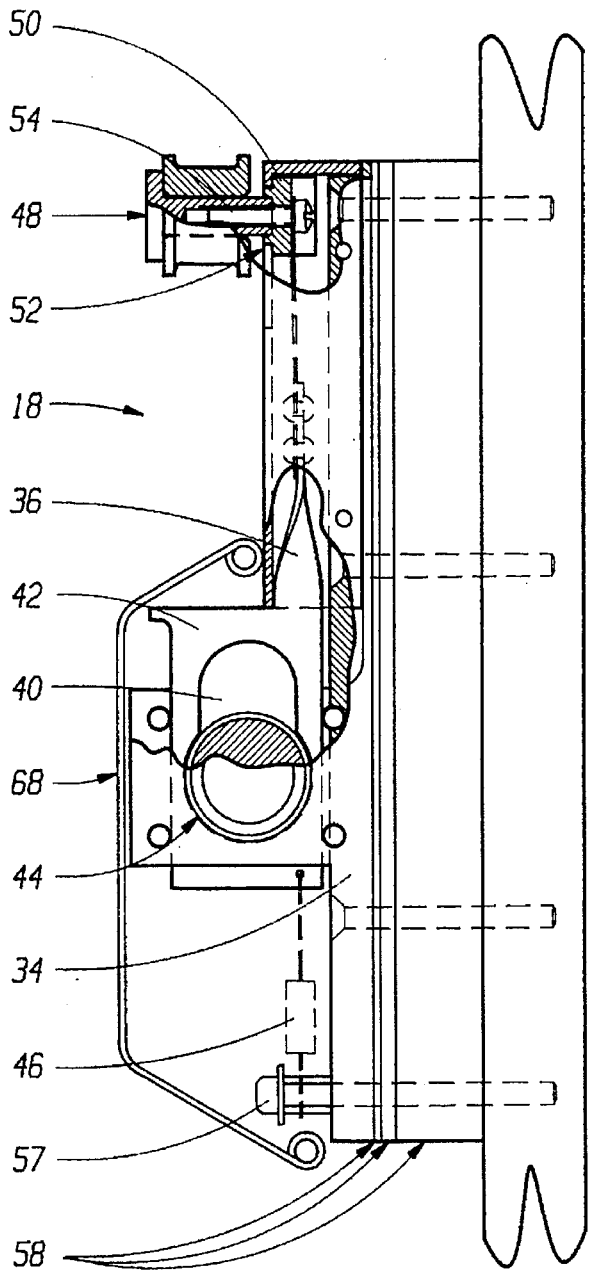
FIG. 5B is a section view of the handle taken along line 5B in FIG. 5A.

Handle or bracket 18, shown in FIGS. 3, 5A and 5B, includes a housing cover 34 and engagement plate 36. Housing cover 34 has a slot 38 therein for slidably receiving engagement plate 36. Engagement plate 36 is designed to have an engagement position and a release position. When engagement plate 36 is in the release position it allows the door to be opened manually. When engagement plate 36 is in the engagement position the door is opened and closed by the rotation of rod 16.

Engagement plate 36 has a pear shaped aperture 40 (FIG. 5B) formed therein for receiving rod 16. In the engagement position, the narrow portion 42 of pear shaped aperture 40 engages rod 16 and, in the release position, the wide portion 44 of pear shaped aperture 40 clears rod 16. Engagement plate 36 is biased into the engagement position by extension spring 46. Engagement plate 36 may be slid into the release position by moving plunger 48 upwardly. Engagement plate 36 is held in the release position by bringing plunger base 50 into aperture 52. Aperture 52 is formed in housing cover 34 and shaped to receiver plunger base 50. Shaft 54 connects plunger 48 to plunger base 50. A slot 56, connected to aperture 52, is formed in housing cover 34 to provide a path to slide shaft 54. Engagement plate 36 is shaped so that plunger base 50 is biased outwardly so that when plunger base reaches aperture 52 it will remain there until released by pushing plunger 48.

Handle or bracket 18 is attached to moveable door 24 with a plurality of screws 57. Handle 18 is positioned so that rod 16 is horizontal and shims 58 are provided so that rod 16 is parallel to stationary door 22. It will be appreciated by those skilled in the art that the handle could be attached in a number of different ways including by way of an adaptor bracket.

Figure 4:
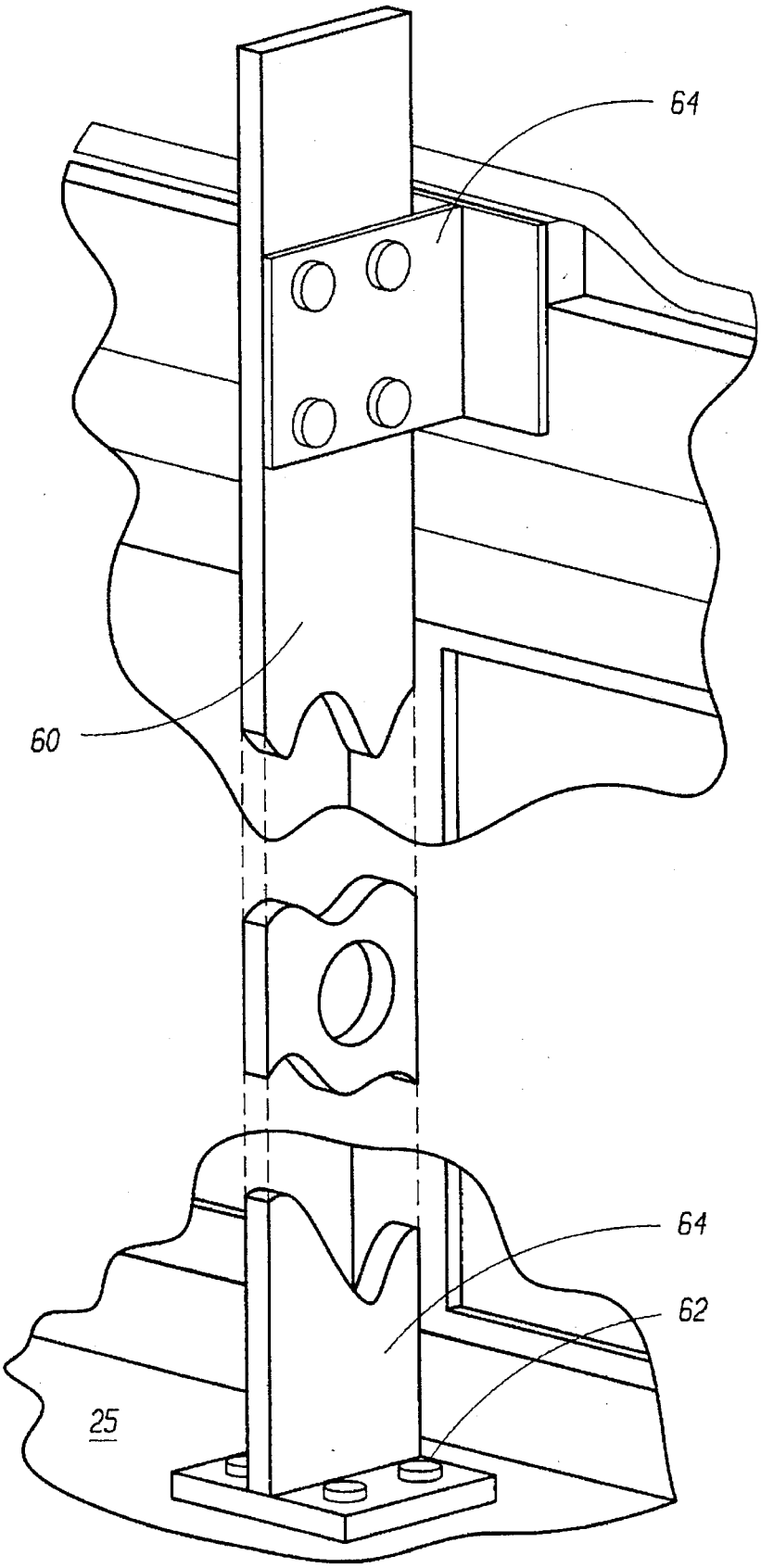
FIG. 4 is a perspective view of the vertical support of the door opening and closing device.

A vertical support 60, shown in FIGS. 1 and 4, is provided to keep rod 16 in position. Vertical support 60 is attached to house 25 at the bottom by screws 62 and at the top by bracket 64.

A shield 68 covers rod 16 and is spaced therefrom. Shield 68 is attached to motor support bracket 28 and to vertical support member 60.

Figure 13:
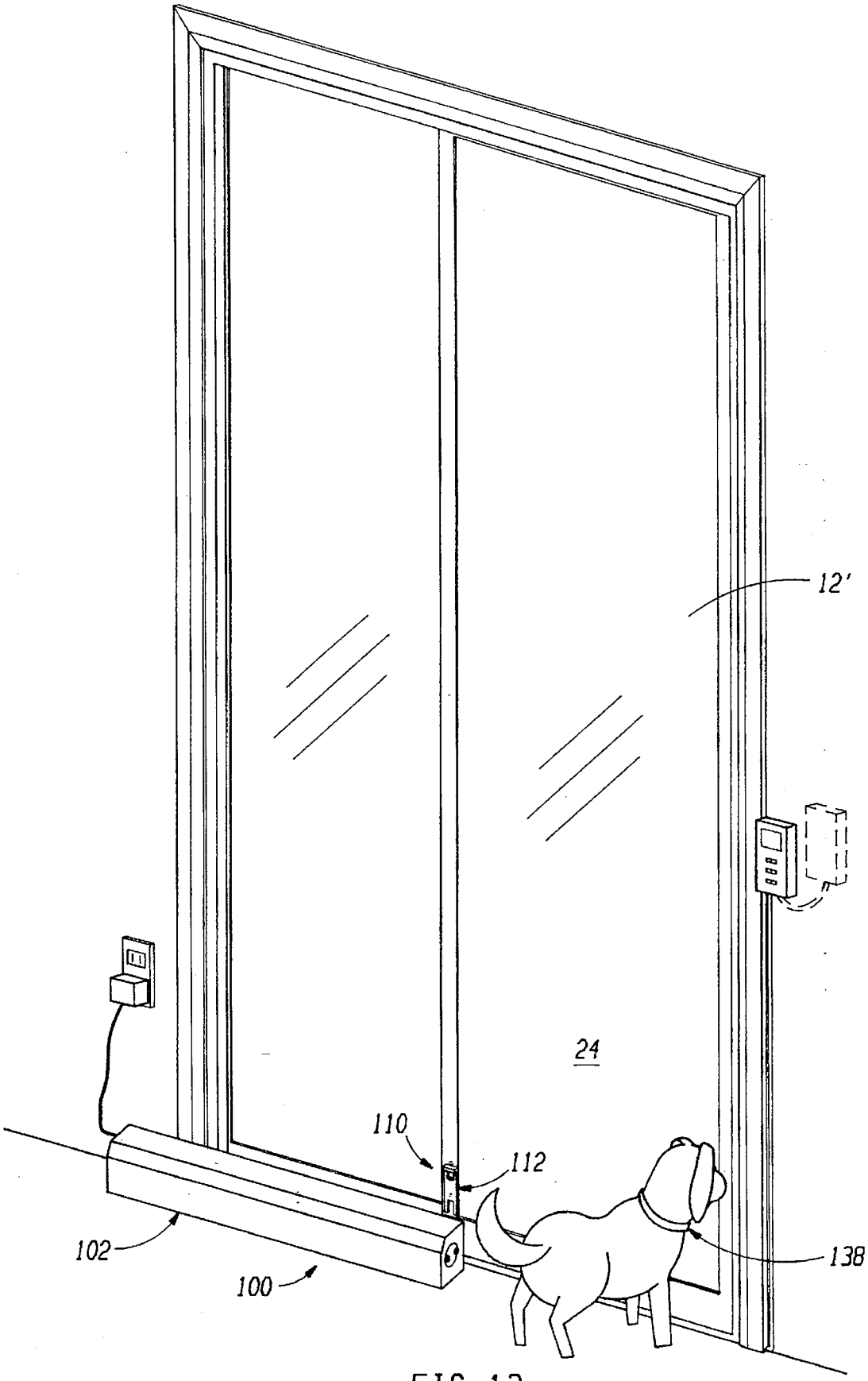
FIG. 13 is a perspective view of the electro-mechanical door opening and closing device similar to that shown in FIG. 9 and including a pet collar as a means to activate the controller.

Controller 20 is electrically connected to control system and motor 14 by cable 21. Control system activates the motor 14 to rotate rod 16 either clockwise or counterclockwise to open or close movable sliding door 24. In addition control system turns off motor 14 when the safety mechanism triggers that message. The features of the controller may be determined by those skilled in the art. For instance control system could be set so that the door is opened and then after a predetermined amount of time it is closed. Alternatively control system could be set up so that motor 14 needs to be actuated each time the door is either opened or closed. The controller may be set up so that it is voice activated, this would be advantageous particularly for dogs so that the dog could bark to open the door. Further, the controller could be set up so that it could be activated by way of remote control. The controller could also be set so that it could be activated by a proximity sensor which is triggered when a pet collar 138 (shown in FIG. 13) comes within a predetermined range. However, preferably in all of the alternatives the controller would include a locking mechanism so that the door can be locked. In addition, the outside activator could be a push button key type mechanism.

Figure 8A:
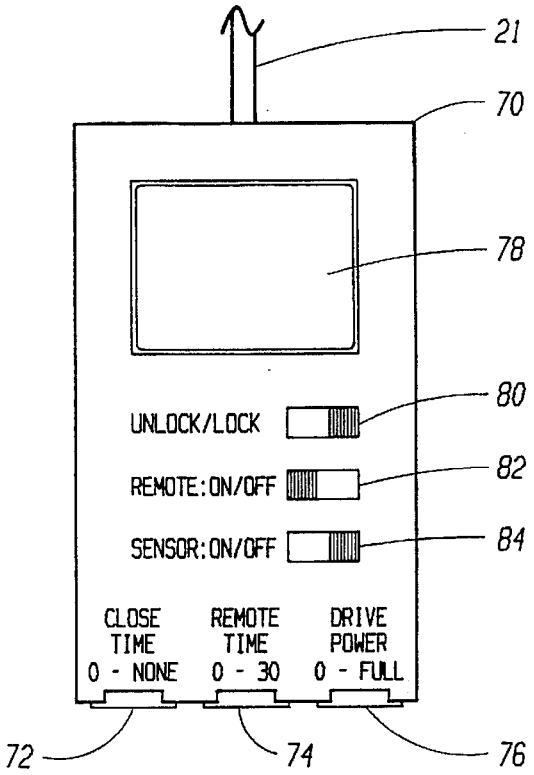
FIG. 8A is s a front view of a controller adapted to be connected to the motor of the door opening and closing device.
Figure 8C:
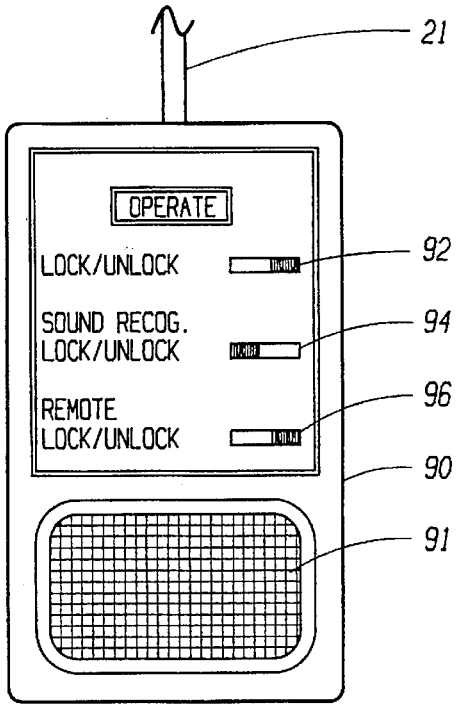
FIG. 8C is a front view of a controller adapted to be connected to the motor of the door opening and closing device.
Figure 8B:
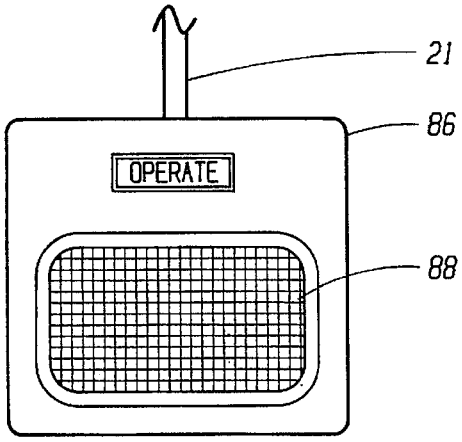
FIG. 8B is a front view of a controller adapted to be connected to the motor of the door opening and closing device.

A number of examples of controller 20 are shown in FIGS. 8A, 8B and 8C. FIG. 8A shows a controller 70 which includes a number of dials which allows the user to adjust the close time 72, remote time 74 and drive power 76. Controller 70 includes a button 78 and switches 80, 82 and 84 to unlock/lock device 80, to turn remote on and off 82 and to turn a sensor on and off. FIG. 8B shows a controller 86 with a single button 88 which would be particularly applicable for mounting outside. FIG. 8C shows a controller 90 which includes button 91 and switches 92, 94, 96 to unlock/lock device 92, lock/unlock sound recognition feature 94 and lock/unlock remote feature 96.

Figure 7:
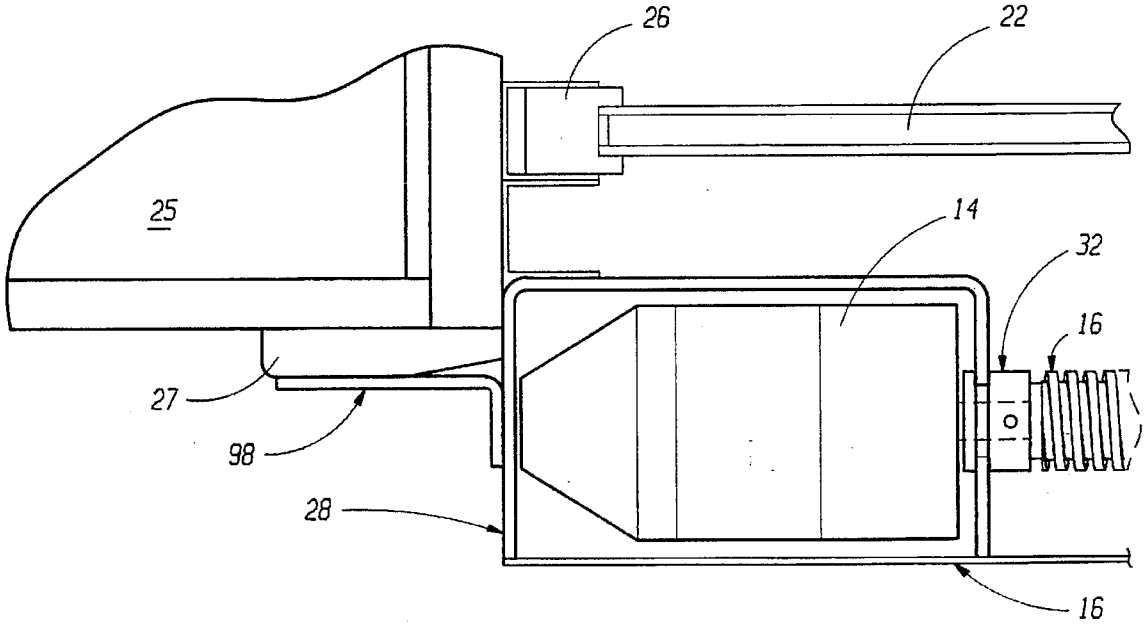
FIG. 7 is a top view of an alternate method of attachment of the motor of the door opening and closing device to the house.

FIG. 7 shows an alternate method of attaching motor 14 to doors 12. Where door frame 26 is recessed outwardly from the plane of the inside of house 25, an angle 98 is attached to moulding 27 and support bracket 28 is attached to angle 96. The remainder of device 10 would be as described above and where applicable is shown and numbered on the drawing.

The above description showed the motor 14 attached to the house 25 through molding 27 and the handle 18 attached to movable door 24, however, it will be appreciated by those skilled in the art that the motor 14 could be attached to movable door 24 and handle attached to house 25.

Figure 9:
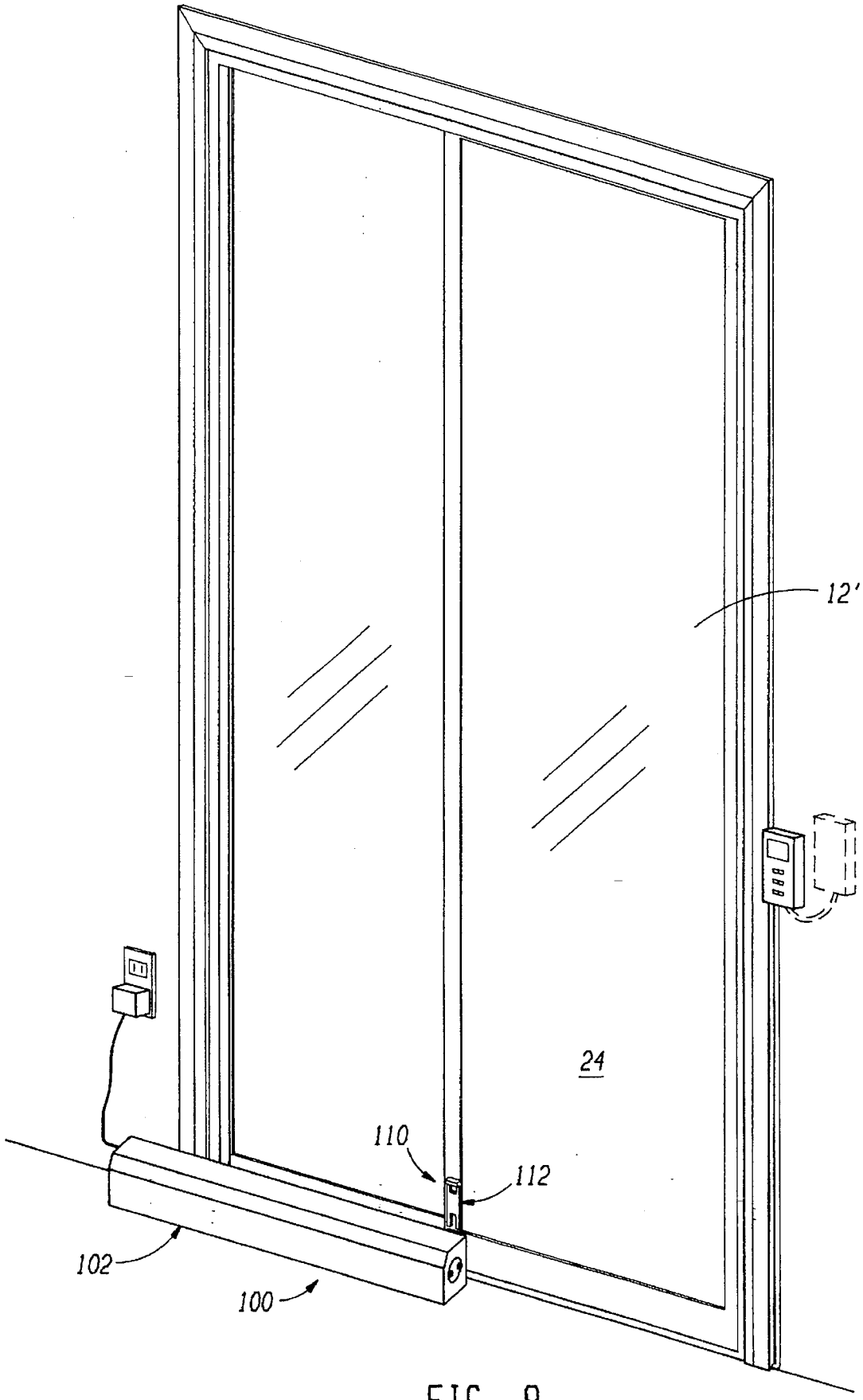
FIG. 9 is a perspective view of an alternate embodiment of the electro-mechanical door opening and closing device constructed in accordance with the present invention and installed on a sliding door system.
Figure 10:
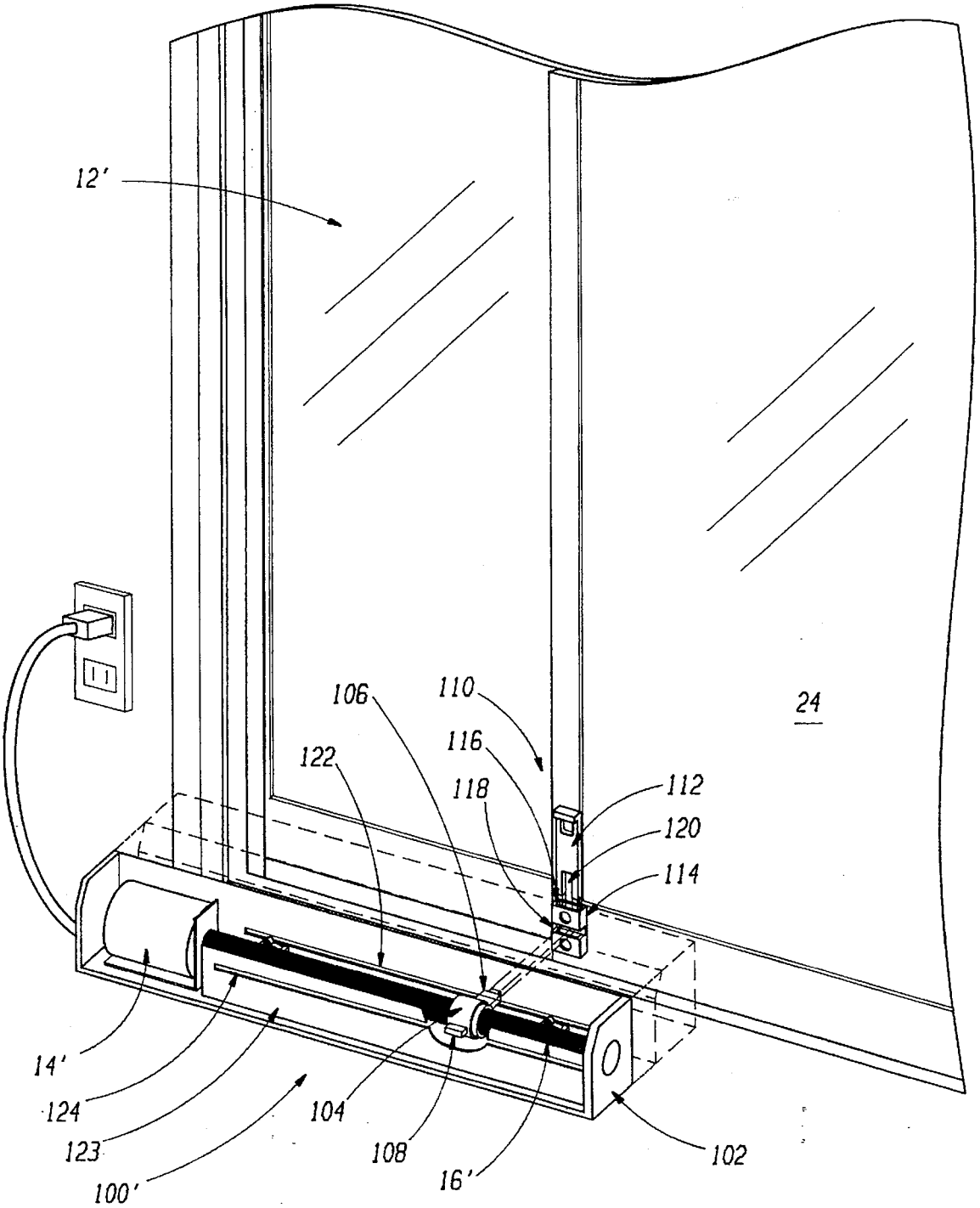
FIG. 10 is an enlarged broken away perspective view of bottom portion a sliding door of the embodiment of FIG. 9 with the shield removed.
Figure 11:
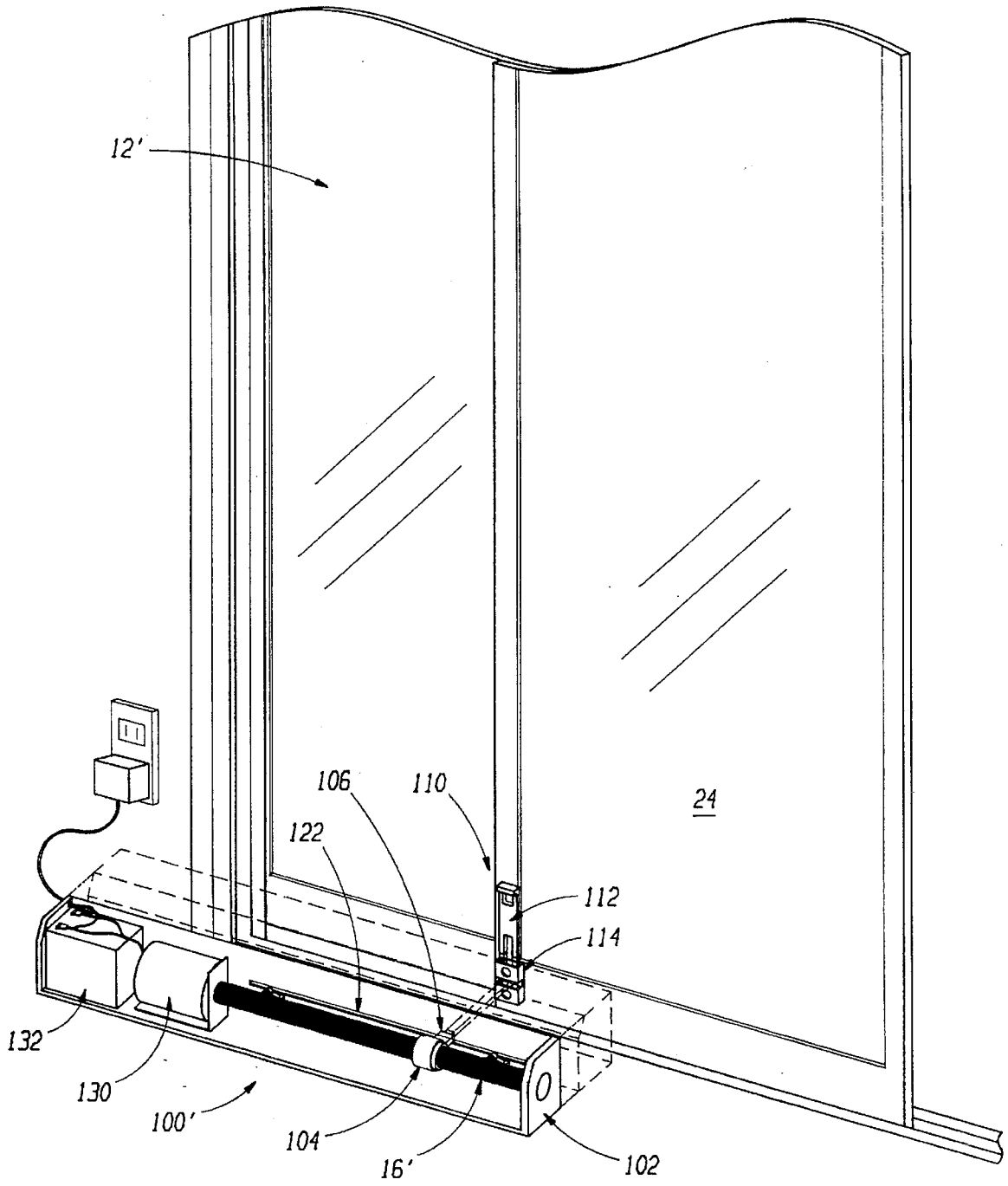
FIG. 11 is an enlarged broken away perspective view of bottom portion a sliding door of the similar to the embodiment of FIG. 10 but including a rechargeable battery.
Figure 12:
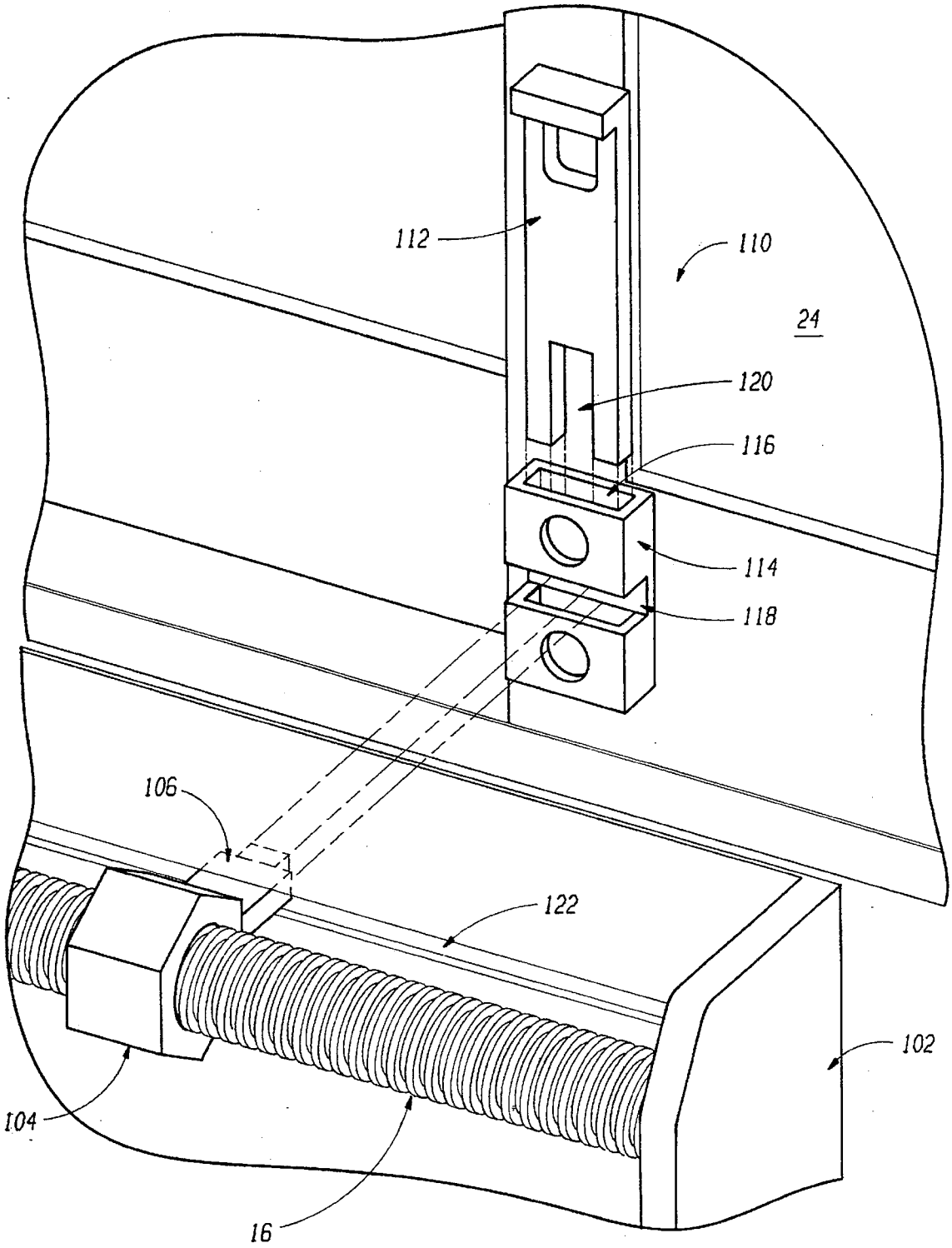
FIG. 12 is an enlarged view of the connection mechanism between the embodiment of FIG. 11 and the sliding door.

FIGS. 9 and 10 show an alternate embodiment of the electro-mechanical door opening and closing device and which is shown generally at 100. FIGS. 11 and 12 show a device 100' which includes a slight variation to that of FIGS. 9 and 10 in that device 100' includes a DC motor with a rechargeable battery which will be described in detail below. Device 100 will be described and only those portions of device 100' that differ from 100 will be described. Only those portions of devices 100 and 100' which differ from those described above will be described. Similar numerals with a' will be used for similar elements.

Device 100 is adapted to be installed on the floor adjacent to the sliding door system 102. Aesthetically device 100 is less obtrusive since it is installed on the floor. Device 100 includes a reversible motor 14', a threaded rod 16' operably connected to the reversible motor and operably connected to the slidable door 24' and a control system. A housing 102 is adapted to be installed on the floor adjacent to sliding doors 12'.

Threaded rod 16' has a nut 104 slidably attached thereto. Nut 104 has an attachment portion 106 and an optional guide portion 108 extending outwardly therefrom on opposed sides thereof. Attachment portion 106 of nut 104 engages bracket 110. Bracket 110 includes a sliding lug 112 and a receiving bracket 114 having an aperture 116 formed therein for receiving lug 112. Receiving bracket 114 has a slot 118 formed therein for receiving attachment portion 106 of nut 104. Receiving bracket 114 is attached to the slidable door 24'. Lug 112 has an slot 120 extending upwardly from the bottom thereof which engages attachment portion 106 of nut 104 when it is in the engaged position. FIG. 10 shows lug 112 in the release position wherein sliding door 24' can move freely. In use, attachment portion 106 of nut 104 is positioned in slot 118 of receiving bracket 114 and lug is slid into aperture 116 so that device 100 is operably attached to sliding door 24'.

Housing 102 has an attachment aperture 122 for receiving attachment portion 106 of nut 104 and a guide member 123 within an aperture 124 formed therein for receiving guide portion 108 of nut 104. Aperture 122 and 124 help position nut 104 in housing 102 as nut 104 moves along threaded rod 16'. Shield 126 (shown in FIG. 9) covers rod 16' and forms part of housing 102.

Device 100' shown in FIGS. 11 and 12 includes a DC motor 130 which is operably attached to a rechargeable battery 132. It does not include a guide portion 108 or a guide member 123. Preferably motor 130 is a 75 watt motor which is not strong enough to cause bodily harm. This embodiment is advantageous particularly in the event of a power failure since it is not totally dependent on generally available power systems. Further it is advantageous in those regions where there is a risk of flood since it uses a DC motor rather than a high voltage motor.

The embodiments shown in FIGS. 9 and 10 and 11 and 12 are advantageous because they are very straightforward to install. Bracket 114 is attached to movable panel 24'. Housing 102 is attached to the floor with any convenient method and is positioned so that attachment portion 106 of nut 104 can engage bracket 114. Further the device has a very quick and easy release mechanism.

The embodiment of the present invention show an electro-mechanical door opening and closing device with are easy to install, have relatively few moving parts and therefore is economical to manufacture and is easily released so that the door can be opened manually if required. It will be appreciated by those skilled in the art that when the device of the present invention is installed it provides a level of security because when bracket 18 or 114 is in the engaged position the door can only be opened by the device thereby the device acts as a lock.

It will be appreciated that the above description was by way of example only. Many variations on the invention will be obvious to those skilled in the art and such obvious variations are within the scope of the invention as described herein whether or not expressly described. Further, it will be appreciated that alternatively this device could be attached to a window.

What is claimed as the invention is:

1. An electro-mechanical device adapted to be retro-fitted onto an existing manually operated sliding door system installed in a wall of a building, the sliding door system having a movable panel, a stationary panel, and a door frame and a stationary portion includes the stationary panel, the door frame, the wall and floor adjacent thereto, comprising:

a reversible motor attachable to one of the stationary portion and the movable panel;

a threaded rod connected to the reversible motor for turning the threaded rod clockwise and counterclockwise;

a bracket attachable to the other of the stationary portion end the movable panel and movably connected to the threaded rod wherein turning the threaded rod clockwise and counterclockwise moves the bracket towards and away from the reversible motor thereby opening and closing the sliding panel and wherein the bracket comprises a disengagable coupling mechanism for coupling the bracket to the threaded rod whereby the disengagable coupling mechanism includes an engagement position, wherein the slidable panel is moved by the threaded rod, and a release position, wherein the movable panel is moved manually; and a control system operably connected to the reversible motor to control activation, direction and deactivation of the motor.

2. An electro-mechanical device according to claim 1 wherein the reversible motor is attachable to the stationary portion of the sliding door system.

3. An electro-mechanical device according to claim 1 wherein the threaded rod and the bracket in the engagement position act as a lock to resist the manual movement of the sliding panel.

4. An electro-mechanical device according to claim 3 wherein the reversible motor is a reversible DC motor and further including a battery operably attached to the reversible DC motor.

5. An electro-mechanical device according to claim 4 wherein the battery is a rechargeable battery.

6. An electro-mechanical device according to claim 1 wherein the control system comprises a controller that is manually activated by a user and wherein the controller activates and deactivates the motor.

7. An electro-mechanical device according to claim 6 wherein the controller activates the motor to open the sliding panel and after a predetermined time activates the motor in the opposite direction to close the sliding panel.

8. An electro-mechanical device according to claim 6 wherein the controller further comprises a remote control device.

9. An electro-mechanical device according to claim 6 wherein the controller further comprises a proximity sensor for sensing the proximity of a pet collar such that the controller is activated when the pet collar is in an effective range.

10. An electro-mechanical device according to claim 9 wherein the control system further comprises a motion detector for turning off the motor when something enters a predetermined area.

11. An electro-mechanical device according to claim 6 wherein the control system further comprises a torque sensor for turning off the motor when the power required to move the threaded rod increases above an effective level.

12. An electro-mechanical device according to claim 11 wherein the control system further comprises a heat sensor for turning off the motor when someone touches the heat sensor.

13. An electro-mechanical device according to claim 11 wherein the control system further comprises a motion detector for turning off the motor when something enters a predetermined area.

14. An electro-mechanical device according to claim 6 wherein the control system further comprises a heat sensor for turning off the motor when someone touches the heat sensor.

15. An electro-mechanical device attached to a sliding door system which is adapted to be installed in a wall of a building, the sliding door system having a movable panel and a stationary panel, comprising:

a reversible motor attached to one of the stationary panel and the movable panel;

a threaded rod connected to the reversible motor for turning the threaded rod clockwise and counterclockwise;

a bracket attachable to the other of the stationary portion and the movable panel and slidably connected to the threaded rod wherein turning the threaded rod clockwise and counterclockwise moves the bracket towards and away from the motor thereby opening and closing the sliding panel and wherein the bracket comprises a disengageable coupling mechanism for coupling the bracket to the threaded rod whereby the disengageable coupling mechanism includes an engagement position, wherein the slidable panel is moved by the threaded rod, and a release position, wherein the movable panel is moved manually; and a control system operably connected to the reversible motor to control activation, direction and deactivation of the motor.

16. An electro-mechanical device according to claim 15 wherein the reversible motor is attached to the stationary portion of the sliding door system.

17. An electro-mechanical device according to claim 15 wherein the threaded rod and the bracket in the engagement position act as a lock to resist the manual movement of the sliding panel.

* * * * *